US009731169B2

(12) United States Patent
Sharp

(10) Patent No.: US 9,731,169 B2
(45) Date of Patent: Aug. 15, 2017

(54) BALL

(71) Applicant: Limpet Sports Management B.V., Bussum (NL)

(72) Inventor: Jacqueline Lisa Sharp, Sydney (AU)

(73) Assignee: Limpet Sports Management B.V., Bussum (NL)

( * ) Notice: Subject to any disclaimer, the term of this patent is extended or adjusted under 35 U.S.C. 154(b) by 0 days.

(21) Appl. No.: 15/029,456

(22) PCT Filed: Oct. 15, 2014

(86) PCT No.: PCT/IB2014/065340
§ 371 (c)(1),
(2) Date: Apr. 14, 2016

(87) PCT Pub. No.: WO2015/056193
PCT Pub. Date: Apr. 23, 2015

(65) Prior Publication Data

US 2016/0236045 A1 Aug. 18, 2016

(30) Foreign Application Priority Data

Oct. 15, 2013 (ZA) ..... 2013/07672

(51) Int. Cl.
*A63B 43/00* (2006.01)
*A63B 69/00* (2006.01)
(Continued)

(52) U.S. Cl.
CPC ..... *A63B 43/007* (2013.01); *A63B 43/002* (2013.01); *A63B 67/183* (2016.01);
(Continued)

(58) Field of Classification Search
CPC ..... A63B 69/0079; A63B 43/002; A63B 2039/003; A63B 43/007; A63B 67/183; A63B 2243/00; A63B 2208/12
See application file for complete search history.

(56) References Cited

U.S. PATENT DOCUMENTS 211,420 A * 1/1879 Moses ..... A23G 3/50 426/104
439,297 A * 10/1890 Fleischman ..... F41B 3/00 124/5
(Continued)

FOREIGN PATENT DOCUMENTS

CN 201020228 Y 2/2008
WO WO-03/041813 A1 5/2003

OTHER PUBLICATIONS

International Search Report and Written Opinion, International Application No. PCT/IB2014/065340, mailed Jan. 28, 2015.

*Primary Examiner* — Steven Wong
(74) *Attorney, Agent, or Firm* — Marshall, Gerstein & Borun LLP

(57) ABSTRACT

A ball (100) for use in bat and ball games wherein the ball is struck with a bat having an untensioned, rigid ball-striking surface, includes a hollow spherical impact body (112) having a mass of between 10 g and 50 g which enables the use of lightweight bats. The wall of the impact body is of a resiliently compressible material and defines a convexly curved impact zone IB. The ball further includes a flight control assembly (114) including a tail (50) comprising flexible streamers (52), a spacer stem (54) and an anchor fitting (126) for anchoring the spacer stem to the impact body. The configuration of the impact body is such that the impact zone compresses to a minimum compression depth of 12 mm and the impact body bounces to a height of at least 100 cm when the impact body is subjected to a drop test
(Continued)

wherein the impact body is dropped onto a test impact surface.

9 Claims, 13 Drawing Sheets

(51) Int. Cl.
*A63B 67/183* (2016.01)
*A63B 39/00* (2006.01)

(52) U.S. Cl.
CPC .... *A63B 69/0079* (2013.01); *A63B 2039/003* (2013.01); *A63B 2208/12* (2013.01); *A63B 2243/00* (2013.01)

(56) References Cited

U.S. PATENT DOCUMENTS 830,582 A * 9/1906 Fleischman ..... A63B 69/0079 473/575
1,346,991 A * 7/1920 Tatum ..... A63B 43/04 473/594
1,466,609 A * 8/1923 Weaver ..... A63B 39/04 251/149.3
1,518,448 A * 12/1924 Pierce ..... A63B 41/08 473/599
1,582,983 A * 5/1926 Hamblet ..... A63B 43/007 473/575
1,649,458 A * 11/1927 Fewlass ..... A63B 41/08 273/DIG. 20
1,782,254 A * 11/1930 Breidenbach ..... A63B 21/0004 273/453
2,091,684 A * 8/1937 Mabee ..... A63B 39/00 473/609
2,210,024 A * 8/1940 Cayo ..... A63B 21/0004 473/576
2,621,334 A * 12/1952 O'Hare ..... A42B 1/006 2/171.01
2,653,817 A * 9/1953 Tebbetts, Jr. ..... A63B 43/007 24/128
2,948,532 A * 8/1960 Jepsen ..... A63B 43/007 156/294
3,693,972 A * 9/1972 Minchin ..... A63B 43/007 43/43.1
3,829,093 A * 8/1974 Abrams ..... A63B 21/1627 473/575
4,113,257 A * 9/1978 Moffatt ..... A63B 69/0079 473/143
4,248,423 A * 2/1981 Lotfy ..... A63B 43/007 473/571
4,272,076 A * 6/1981 Song ..... A63B 43/007 473/575
4,947,466 A * 8/1990 Horiuchi ..... A63B 39/00 273/DIG. 20
5,224,704 A * 7/1993 Snell ..... A63B 41/00 273/DIG. 20
5,261,661 A * 11/1993 Lemmon ..... A63B 41/00 273/DIG. 20
5,593,157 A * 1/1997 Koros ..... A63B 39/02 473/606
5,813,931 A 9/1998 Gormley
8,128,523 B2 * 3/2012 Laliberty ..... A63B 41/00 273/DIG. 20
2003/0092516 A1 * 5/2003 Gormley ..... A63B 43/007 473/613
2006/0052188 A1 3/2006 Gormley
2013/0085023 A1 * 4/2013 Wang ..... A63B 41/02 473/609
2014/0329626 A1 * 11/2014 Orr ..... A63B 43/007 473/614
2016/0236044 A1 * 8/2016 Orr ..... A63B 43/007

* cited by examiner

BALL

FIELD OF INVENTION

This invention relates to a ball for use in bat and ball games wherein the ball is struck by a bat having an untensioned, rigid ball-striking surface. The invention relates particularly to a ball comprising an impact body having at least one convexly curved impact zone; and flight control means for controlling the orientation of the impact body in flight, such as a tether cord which is attached to the impact body enabling the ball to be used in tethered tennis-type ball games or a tail comprising one or more streamers attached to the impact body, when used in tennis or badminton-type untethered ball games. It will be appreciated that the Applicant envisages that the impact body may not be entirely spherical.

Unless otherwise specified, any reference herein to a "bat" must be interpreted to mean a reference to a bat having an untensioned, rigid planar ball-striking surface.

Reference is also made herein to a "drop test". In this test which is commonly used for balls of various types, an impact body is dropped from a height of 254 cm (100 inches) onto a, rigid, flat, horizontal, solid, smooth test impact surface such as a polished granite slab or steel plate at least 20 mm thick, such that the impact zone lands on the test impact surface wherein the resulting compression of the impact body upon impact with the test impact surface and the height to which the ball bounces after impacting the test impact surface, is measured. In order to determine the bounce height of a ball, the maximum height to which the ball bounces after impacting the test impact surface is measured. For example, the International Tennis Federation specification for the bounce height of a tennis ball is between 135 cm and 147 cm when subjected to a drop test from the same height. A number of techniques are used to measure the compression depth of a ball upon impact with the impact surface. One such technique involves dusting the test impact surface with a marking substance, such as talcum powder, measuring the diameter of the circular impact contact mark ("impact footprint") left behind on the test impact surface after impact by the ball and applying the dimensions of the mark to the geometry of the ball, calculating the depth of compression of the ball upon impact. In a drop test conducted by the Applicant on a standard competition tennis ball weighing 59.4 g, the tennis ball formed an impact contact mark 46 mm in diameter which corresponds to a compression depth of about 9.9 mm. It will be appreciated that the size of the impact footprint is directly related to the compressibility of the ball upon impact. As such, a higher degree of compression of the ball results in more kinetic energy being transferred from a moving bat to the ball during contact with the bat as a result of the ball being in contact with the bat for a longer period of time. Any reference in this specification to a "drop test" must be interpreted to mean the test described hereinabove wherein an impact body is dropped from a height of 254 cm onto a rigid, flat, horizontal, solid test impact surface.

In this specification, reference is made to the "wall thickness" of an impact body. With regard to defining the wall thickness of the hollow impact bodies described in this patent application, it is recognized that there are two basic types of impact bodies. The first type are impact bodies wherein the surfaces of such impact bodies both inside and out are basically smooth and flat with no obvious or significant protuberances or cavities. In impact bodies of this type, the wall thickness may be easily measured in a single reading by applying a calliper gauge to any chosen section of the impact body. The second type of impact body has uneven rough or textured surfaces particularly on outer surfaces thereof which, as in the case of the different field of golf balls, may include dimples, ridges, cavities or depressions which are applied for functional or cosmetic reason. For impact bodies of this type, thickness measurements may vary from point to point depending on the thickness of the localised surface configuration at that point. Where the surface of such balls is so textured, an adequate multiplicity of thickness measurements should be taken at randomly chosen locations in any given test area of the impact body, of at least seven measurements, from which an average wall thickness can be established which may be used for purposes of assessing the wall thickness of such textured impact bodies for the purposes of ascertaining the average wall thickness as is envisaged in this specification.

BACKGROUND TO INVENTION

In the context of this specification, a "tethered ball" is a ball for use in tethered bat and ball games, having a tether cord attached at one end thereof to the impact body and to an anchor point at a location remote from the impact body and around which the impact body is struck.

Further in the context of this specification, a "streamer ball" is a ball for use in tennis or badminton type ball games, of a type having a tail comprising one or more elongate flexible streamers which are attached to the impact body for stabilizing the flight orientation of the impact body. Streamer balls of this type are known.

A streamer ball of this type is disclosed in U.S. Pat. No. 5,813,931 (assigned to Limpet Sports Management BV). The streamer ball comprises a ball and a tail comprising a number of elongate streamers directly attached to the ball and extending therefrom, for use in tennis-type bouncing ball games. U.S. Pat. No. 5,813,931 discloses a number of performance parameters for such a streamer ball and specifically for the tail of the ball, that provide for desired bounce and flight qualities that enable a tennis-type game to be played with such a streamer ball. The use of a tail connected to a ball has a number of benefits when playing a tennis-type ball game. Firstly, the use of a tail which trails behind the ball in flight creates drag which slows the ball down so that when the ball is struck with a bat, the distance that the ball can travel is effectively reduced, thereby permitting a tennis-type ball game to be played in a relatively small area while the ball can still be struck at "full strength".

Yet a further benefit of such a tail is to reduce any tendency of the ball to spin or swerve during flight. The tail streams out behind the ball in flight so as to define a highly visible, dynamically changing and fluttering asymmetrical profile which rapidly reduces any side spin or top spin or swerve which is imparted to the ball upon impact by a bat, thereby causing the ball to follow a regular flight path.

Further benefits of such a tail include the reduction in flight speed provided by the tail which makes it easier to see the ball and a reduction in roll of the impact body on the ground which aids ball retrieval.

An important performance characteristic for a ball which is intended for use in tennis-type bat and ball games where the ball may be hit after it bounces, is that the ball should have sufficient bounce after striking a playing surface or being struck by a bat. A further important performance characteristic for a ball intended for use in tennis-type ball games, is that the ball should provide a solid feel and sound upon impact by a bat with minimal unpleasant handle vibration and a satisfactory rebound speed when leaving the bat after impact.

Strung racquets are usually provided with a network of strings under tension strung across a frame at the head of the racquet. When using a strung racquet, the resilient compressibility of the tensioned network of strings comprising the ball-striking surface of such a racquet, provides a "trampoline effect" which allows the ball to dwell on the ball-striking surface at impact for a significantly longer period of time than is the case with a bat which has an untensioned ball-striking surface. Due to the inherent resilient compressibility of the ball-striking surface of a strung racquet, the balls selected for use therewith can allow for less compression upon impact compared to a ball which is designed to be struck by a relatively rigid-faced bat. An important consideration in the design of a ball for use in bat and ball-type games played with a bat having an untensioned, rigid ball-striking surface, is that the ball should have sufficient resilient compressibility so that when it is struck by the bat, the dwell time of the ball upon the bat or playing surface at impact is sufficiently long as indicated by the relative depth of compression of the ball, so as to transfer adequate kinetic energy to the ball so as to provide the necessary spring off the bat or playing surface and consequently a satisfactory impact feel, sound and impact speed when leaving the bat after impact. The greater the compression of the ball upon impact, the greater the amount of energy which is stored in the ball which in turn causes greater spring off the bat when the energy is released as the ball regains its shape after the initial impact. There is thus a direct relationship between the depth of compression and the amount of energy which is stored by the ball upon impact and released immediately after full compression is achieved. It is for this reason that the current Applicant has sought to design a ball which has a high degree of resilient compressibility in order to achieve a high degree of spring off a bat.

A further important consideration in the design of balls for use in tennis-type bat and ball games played with bats having untensioned, rigid ball-striking surfaces, is that the balls should have sufficient mass in order for the ball to compress sufficiently upon impact in order to provide the trampoline effect referred to above, off a bat or playing surface and also to achieve solid contact between the ball and the ball-striking surface of a bat.

The Applicant has identified a need to supply bats having rigid, untensioned ball-striking surfaces having a relatively low weight. The cost of the bats in sets of bats and balls is the major component of such sets. It is an object of the present invention, to provide for the production of relatively lightweight bats which use less material and are thus relatively inexpensive to produce. It is also a requirement for bats which are to be used by children, that the bats must be relatively lightweight. In order to do so, it is necessary to provide balls for such bats which are correspondingly light in weight and which are matched in terms of their weight to the weight of the particular bat with which the balls are to be used. In this regard, the Applicant believes that such bats should be at least five times heavier than a ball to be used therewith and preferably, at least ten times heavier than the ball so as to provide a solid impact feel and avoid unpleasant jarring and vibration upon impact. It will therefore be appreciated that the balls used with such lighter bats must also be correspondingly light in weight. In tethered tennis-type games which have been around for many years the well known Swingball® tether tennis game uses a standard competition grade tennis ball which is tethered to a pole and which weighs between 56.0 g and 59.4 g without its anchor fitting. These sets are normally supplied with unstrung or untensioned rigid-faced plastic bats which weigh approximately 300 g, which weight has been found appropriate for rigid-faced, unstrung bats to use with these balls and which produce a solid, satisfactory, non-jarring impact feel. While this weight of bat works very well with a regulation tennis ball it has been found too heavy for younger children.

The Applicant has found that known commercially available lightweight balls are unsuitable for use with lightweight bats due to the low mass of such balls being unable to provide for the necessary compression of the ball upon impact with a bat in order to achieve the trampoline effect and a satisfactory solid contact between the ball and the ball-striking surface of the bat with minimal unpleasant handle vibration. The known lightweight balls tested by the Applicant are unable to achieve the compressibility and other requirements such as bounce height required for adequate impact performance, due to their lack of mass and other design characteristics.

It is an object of the present invention to provide a relatively lightweight flight controlled ball suitable for use in bat and ball games, wherein the impact body exhibits a sufficiently high degree of compression upon impact by a bat or playing surface so as to render the ball suitable for use with lightweight bats having untensioned, rigid ball-striking surfaces.

SUMMARY OF INVENTION

According to the invention there is provided a ball for use in bat and ball games wherein the ball is struck with a bat having an untensioned, rigid ball-striking surface, the ball comprising:

a hollow, impact body having a mass of between 10 g and 50 g, the impact body comprising a wall of a resiliently compressible material surrounding an internal space, the wall defining at least one convexly curved impact zone configured for impact by the bat, the part of the wall of the impact body defining the impact zone, having a mass of between 0.15 g and 0.4 g per square centimeter of the wall; and flight control means which is attached to the impact body at an attachment point on the wall of the impact body, the flight control means being operable to control the orientation of the impact body in flight, the configuration of the impact body being such that the impact zone of the impact body compresses to a minimum compression depth of 12 mm and the impact body bounces to a height of at least 100 cm when subjected to said drop test wherein the impact body is dropped onto a test impact surface such that the impact zone of the impact body impacts the test impact surface.

The impact body may have an average wall thickness of between 1 mm and 3 mm. This average wall thickness corresponds with the part of the wall of the impact body defining the impact zone, having a mass of between 0.15 g and 0.4 g per square centimeter of the wall.

Preferably, the impact zone may have a wall thickness of between 1 mm and 3 mm.

In a first embodiment of the invention, the ball is configured for use as a streamer ball. In this embodiment, the flight control means includes a tail comprising at least one elongate thin, flexible streamer configured to trail behind the impact body in flight; and an elongate, resiliently flexible spacer stem having a proximal end which is attached to the wall of the impact body at said attachment point and a distal end which is attached to the tail. The impact zone may be disposed diametrically opposite the attachment point of the spacer stem to the impact body, the central longitudinal axis of the impact body passing through the attachment point and a centre of the impact zone.

In one example of the first embodiment of the ball, the flight control means may further include an anchor fitting having an anchor body for anchoring the spacer stem to the wall of the impact body. As such, the impact body may define a hole within which the anchor body is securely located.

In another example of the first embodiment of the ball, the impact body may define an attachment formation for attaching the spacer stem to the wall of the impact body.

More specifically, the flight control means may further include an anchor fitting including an anchor body which is integrally formed with the spacer stem and which is configured for attachment to the attachment formation of the impact body.

In a second embodiment of the invention, the ball is configured for use as a tethered ball. In this embodiment, the flight control means includes a tether cord having a proximal end which is attached to the wall of the impact body at said attachment point and a distal end which is rotatably attached to an anchor point such as the top of a pole at a location remote from the impact body and around which the impact body is struck, in use. The impact zone may be in the form of an impact band extending around the impact body. More particularly, a tether cord axis extending along the length of the tether cord and passing through the centre of mass of the impact body, passes through a centre of the impact band when the impact band is viewed in plan view.

The flight control means of the second embodiment of the ball, may include an anchor fitting having an anchor body for anchoring the tether cord to the wall of the impact body. As such, the impact body may define a hole within which the anchor body is securely located.

BRIEF DESCRIPTION OF THE DRAWINGS

Further features of the drawings are described hereinafter by way of non-limiting examples of the invention, with reference to and as illustrated in the accompanying diagrammatic drawings. In the drawings.

DESCRIPTION OF PREFERRED EMBODIMENTS

Figure 1:
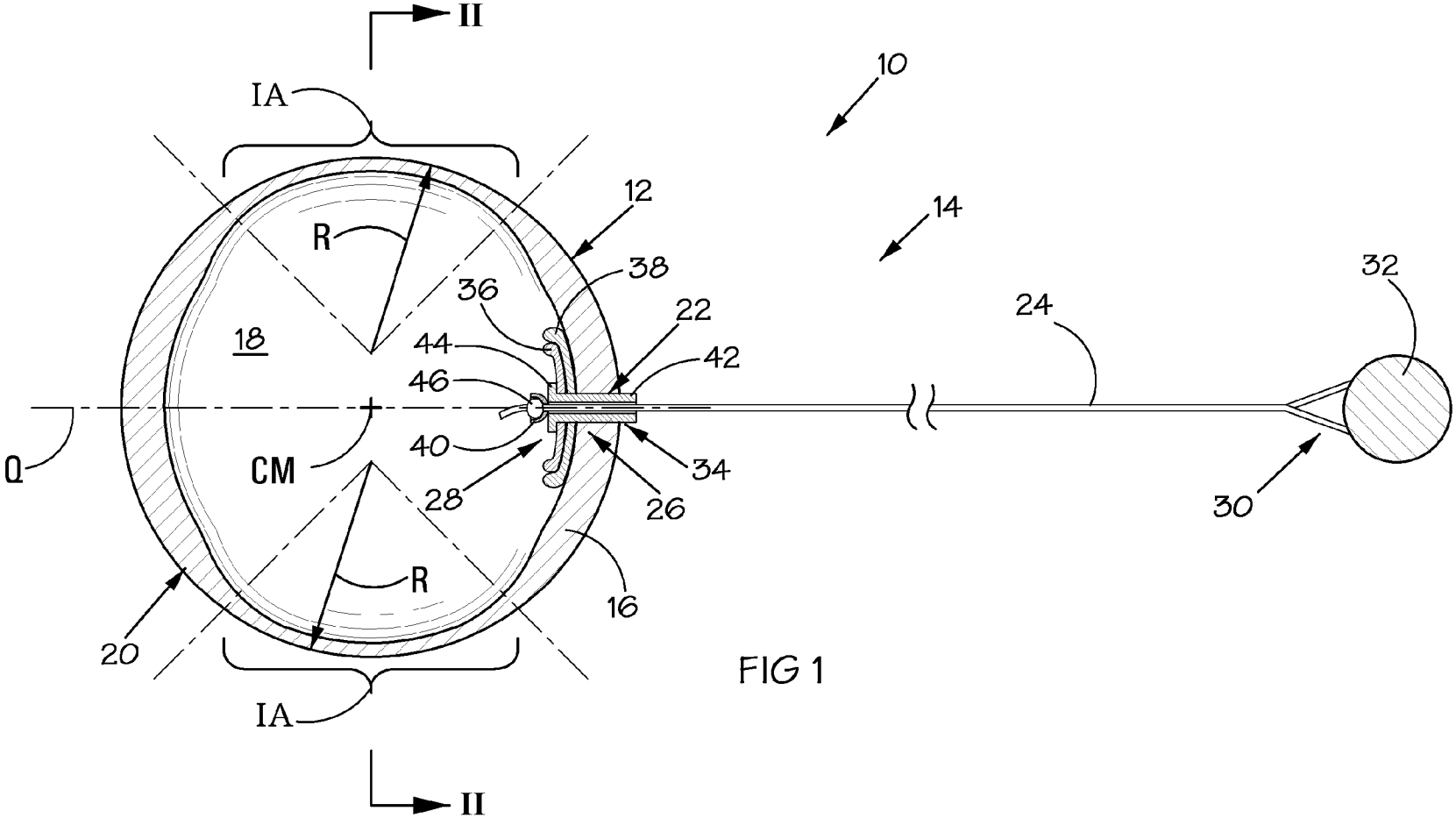
FIG. 1 shows a sectional top view of a ball in accordance with the invention, which is configured for use as a tethered ball.

With reference to FIGS. 1 to 5 of the drawings, a ball in accordance with the invention which is configured for use as a tethered ball, is designated generally by the reference numeral 10. The ball 10 is specifically configured for use with bats having untensioned rigid ball-striking surfaces. The ball 10 comprises, broadly, a hollow spherical impact body 12 and flight control means in the form of a flight control assembly designated generally by the reference numeral 14.

The impact body comprises a wall 16 of a resiliently compressible high grade rubber or rubber-like material surrounding an internal space 18. The wall defines a substantially smooth external surface 20. The impact body has a mass of between 10 g and 50 g and defines a centre of mass CM. The impact body defines a hole 22 of between 3 mm and 20 mm in diameter, providing an attachment point for the flight control assembly 14.

Figure 2:
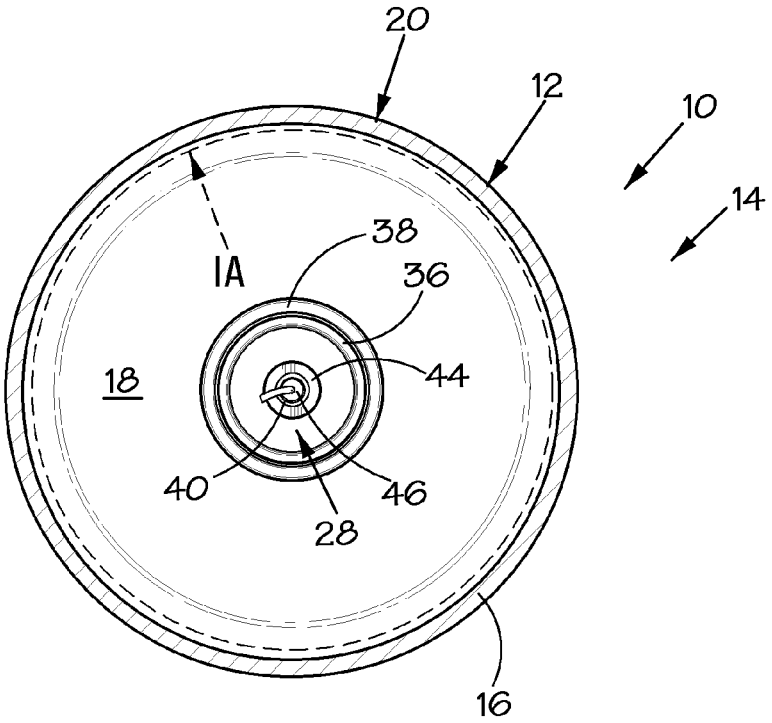
FIG. 2 shows a sectional front view of FIG. 1 as viewed along section line II-II of FIG. 1.
Figure 3:
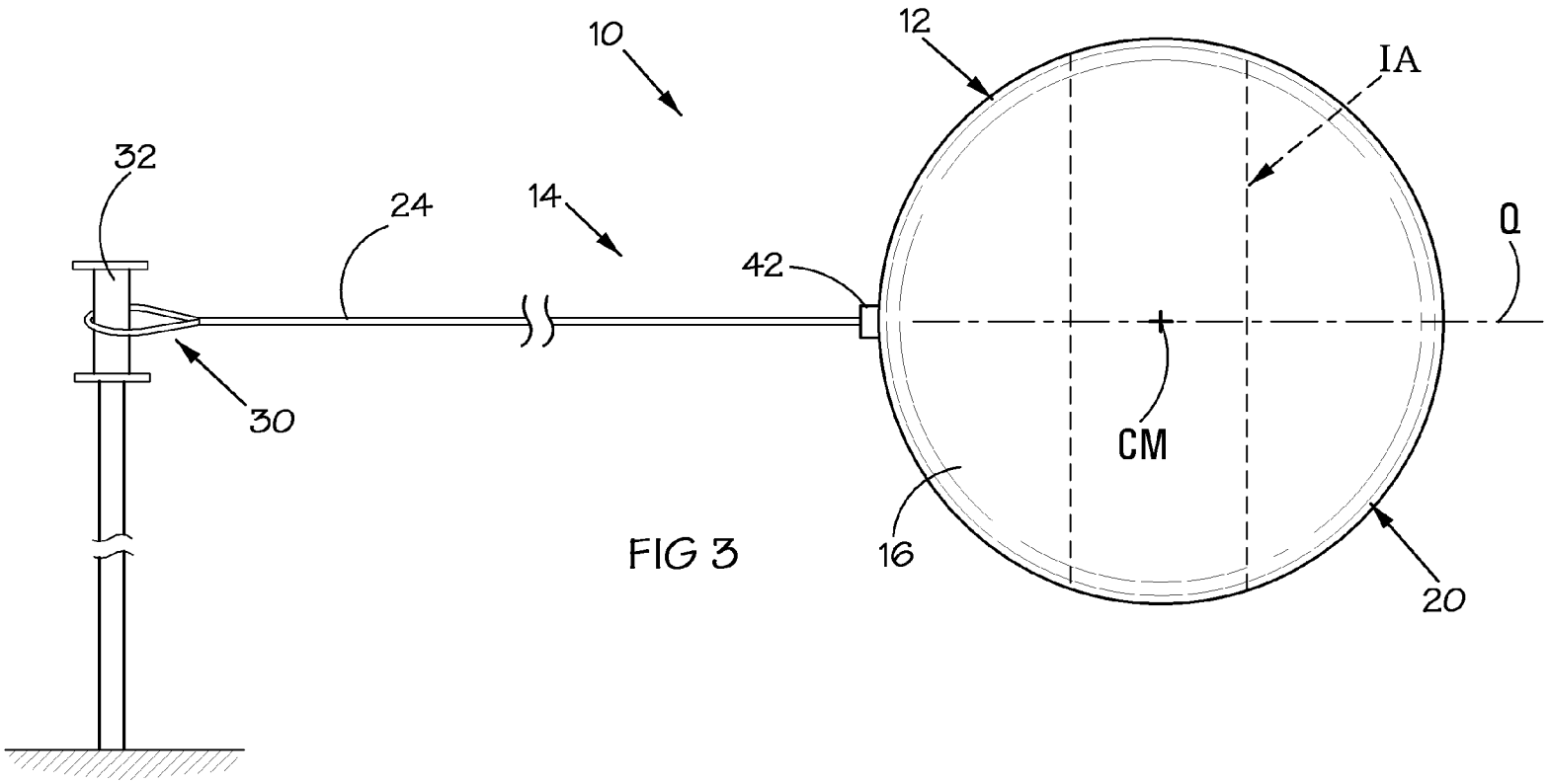
FIG. 3 shows a side view of the ball of FIG. 1.
Figure 4:
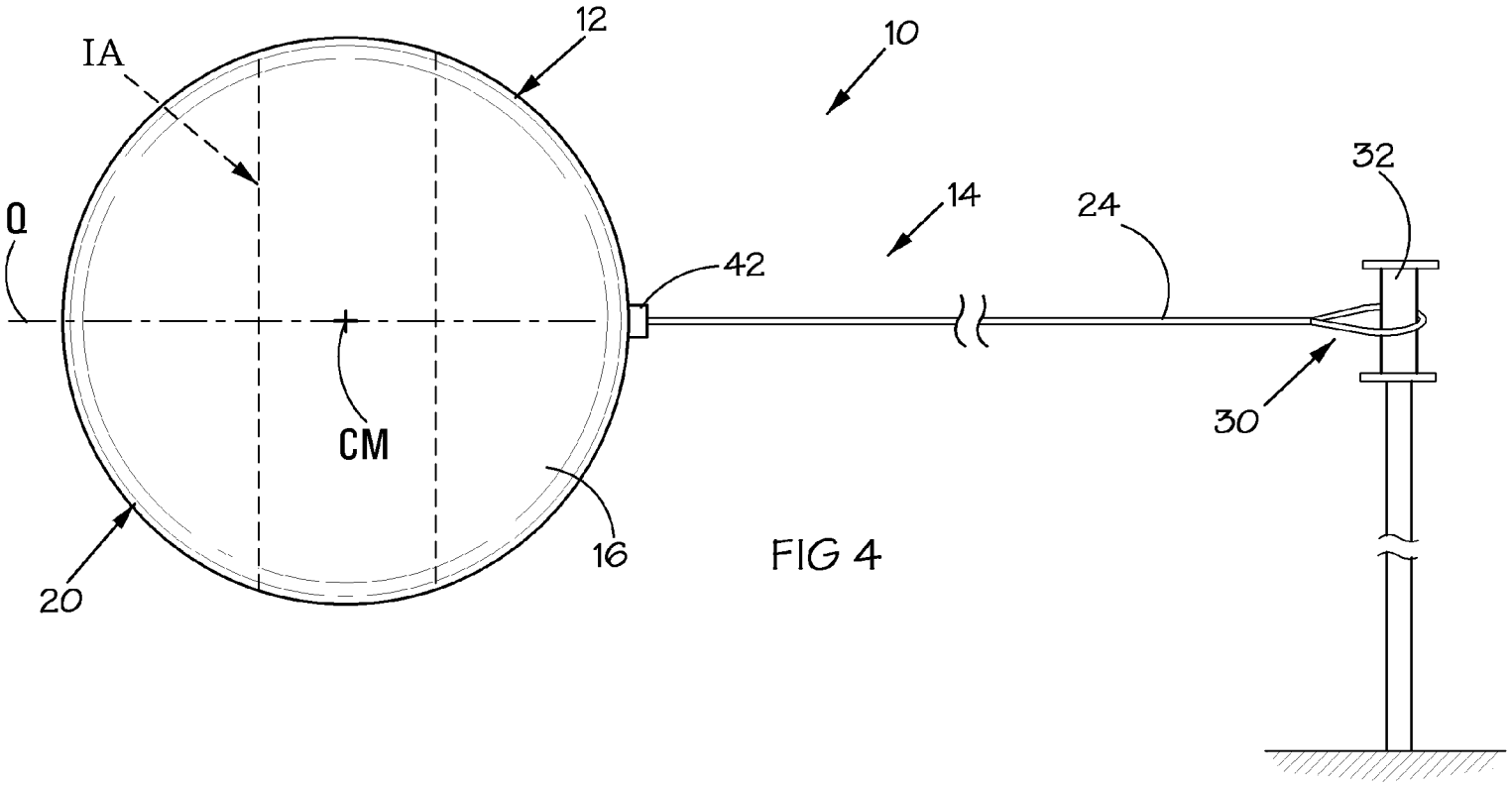
FIG. 4 shows an opposite side view of the ball of FIG. 1.

The impact body defines an impact zone IA in the form of a circular impact band which extends around the impact body as is shown more clearly in FIGS. 2, 3 and 4. The impact band is defined by the wall of the impact body and preferably has a wall thickness between a minimum of 1 mm and a maximum of 3 mm. In the illustrated example, the wall thickness of the wall of the impact zone, is uniform. It will be appreciated, however, that the wall thickness of the impact body within the impact zone IA may vary between 1 mm and 3 mm. The thickness of the wall of the impact body in regions outside of the impact zone of the impact body 12, is relatively thicker. The impact zone is thus defined by a reduction in the wall thickness of the impact body. The extra weight provided by the thicker wall section outside of the impact zone contributes to the overall weight of the impact body thereby increasing the compression depth of the impact body at impact. The impact zone IA is convexly curved and has a predetermined radius of curvature "R" defined along an outer profile of the wall. The part of the wall of the impact body defining the impact zone, has a mass of between 0.15 g and 0.4 g per square centimeter of the wall, corresponding to an average wall thickness of between 1 mm and 3 mm.

The flight control assembly 14 includes a tether cord 24 and an anchor fitting 26 for anchoring the tether cord to the wall of the impact body. More specifically, the tether cord has a proximal end 28 and a distal end 30, with the distal end 30 being rotatably attached to an upright post 32 which is anchored in the ground, in use.

The anchor fitting 26 comprises, broadly, an anchor body 34, a disc-shaped shoulder-defining body 36, a flexible resilient cushioning washer 38 and a bearing body 40 which is connected to the distal end 28 of the tether cord 24. More specifically, the anchor body 34 comprises an elongate shank portion 42 and a head 44 at an inner end of shank portion, the shank portion operatively extending through the hole 22 defined in the wall of the impact body. The anchor body defines an axial passage which extends along the elongate shank portion and the head and through which the tether cord 24 extends. The tether cord has a stop formation 46 at its distal end, with the bearing body being operatively located between the stop formation and the head 44 of the anchor body thereby to operatively bear against the head of the anchor body, in use, so as to be rotatable relative to the head 44 to permit free rotation of the tether cord within the axial passage defined through the elongate shank portion on the head of the anchor body. It will be appreciated that the axial passage in the anchor body permits air flow communication between the internal space 18 of the impact body and ambient pressure externally of the impact body, thereby resulting in the internal space 18 of the impact body having an internal pressure equal to ambient pressure when the impact body is in a relaxed state and not deformed inwardly by a blow from a bat. The washer 38 is located between the shoulder-defining body 36 and an interior side of the wall 16 and serves to cushion and absorb impacts from blows to the impact body by a bat so as to protect the interior side of the wall of the impact body from point loads applied to the impact body from blows by a bat, in the region where the anchor fitting is fitted to the impact body.

The tether cord 24 defines a tether cord axis Q which extends along the length of the tether cord and passes through the centre of mass CM of the impact body and extends through the centre of the impact band IA of the impact body when the tether cord is under tension, in use.

The ball 10 is configured to be struck at the impact zone IA during a tether tennis-type ball game. It will be appreciated that after being struck by a bat, the impact body changes direction and typically spins on its axis after impact.

The configuration of the impact body and in particular, the reduced wall thickness of the impact body within the impact zone, is such that the impact zone at the leading end region, of the impact body compresses to a minimum compression depth of 12 mm upon impact by a bat and bounces to a height of at least 100 cm when the impact body is subjected to the drop test as described hereinabove.

Figure 5:
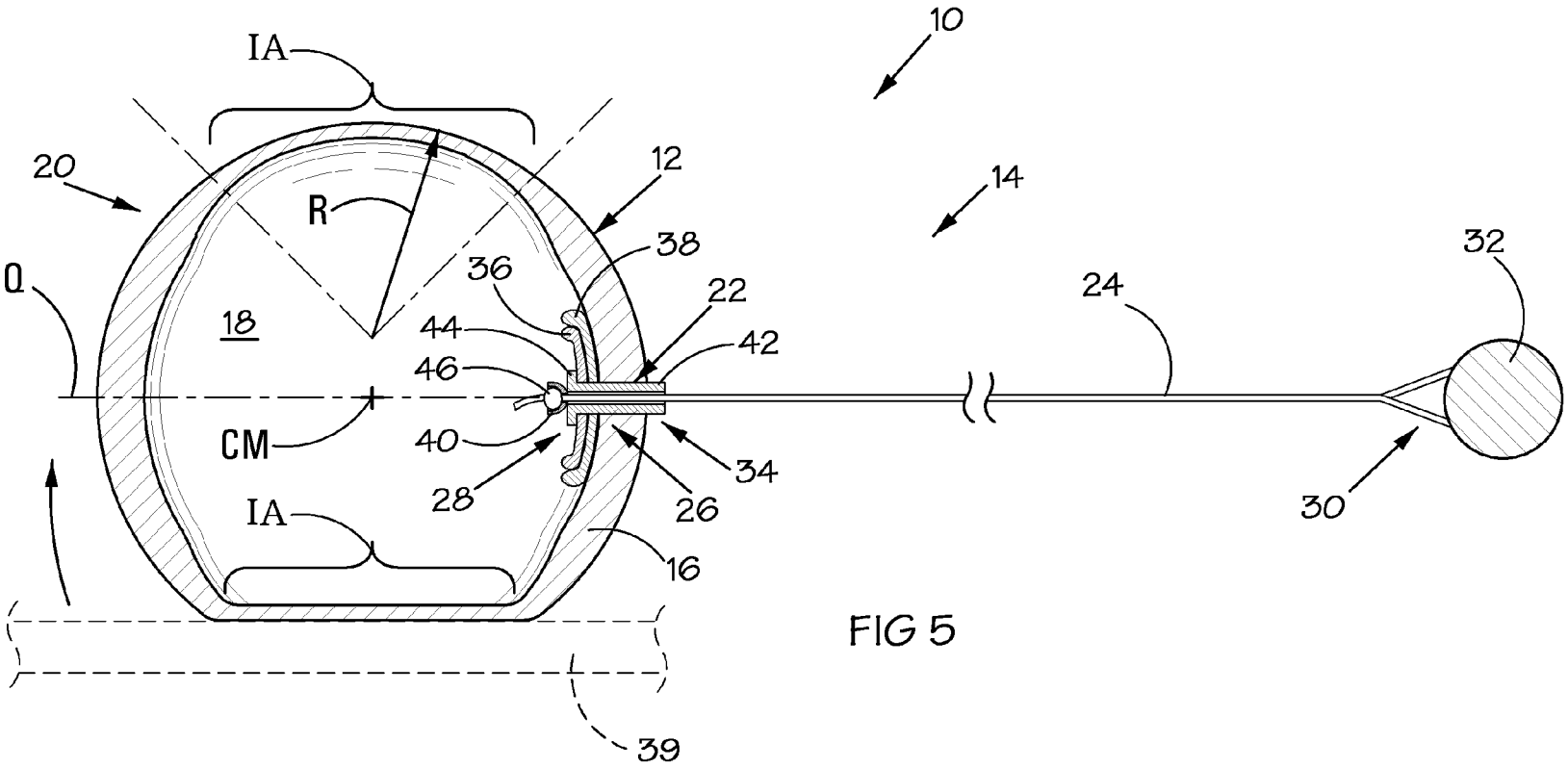
FIG. 5 shows a sectional top view of the ball of FIG. 1, sectioned along sectional line V-V of FIG. 1, illustrating the deformation of the impact body when struck by a bat.
Figure 6:
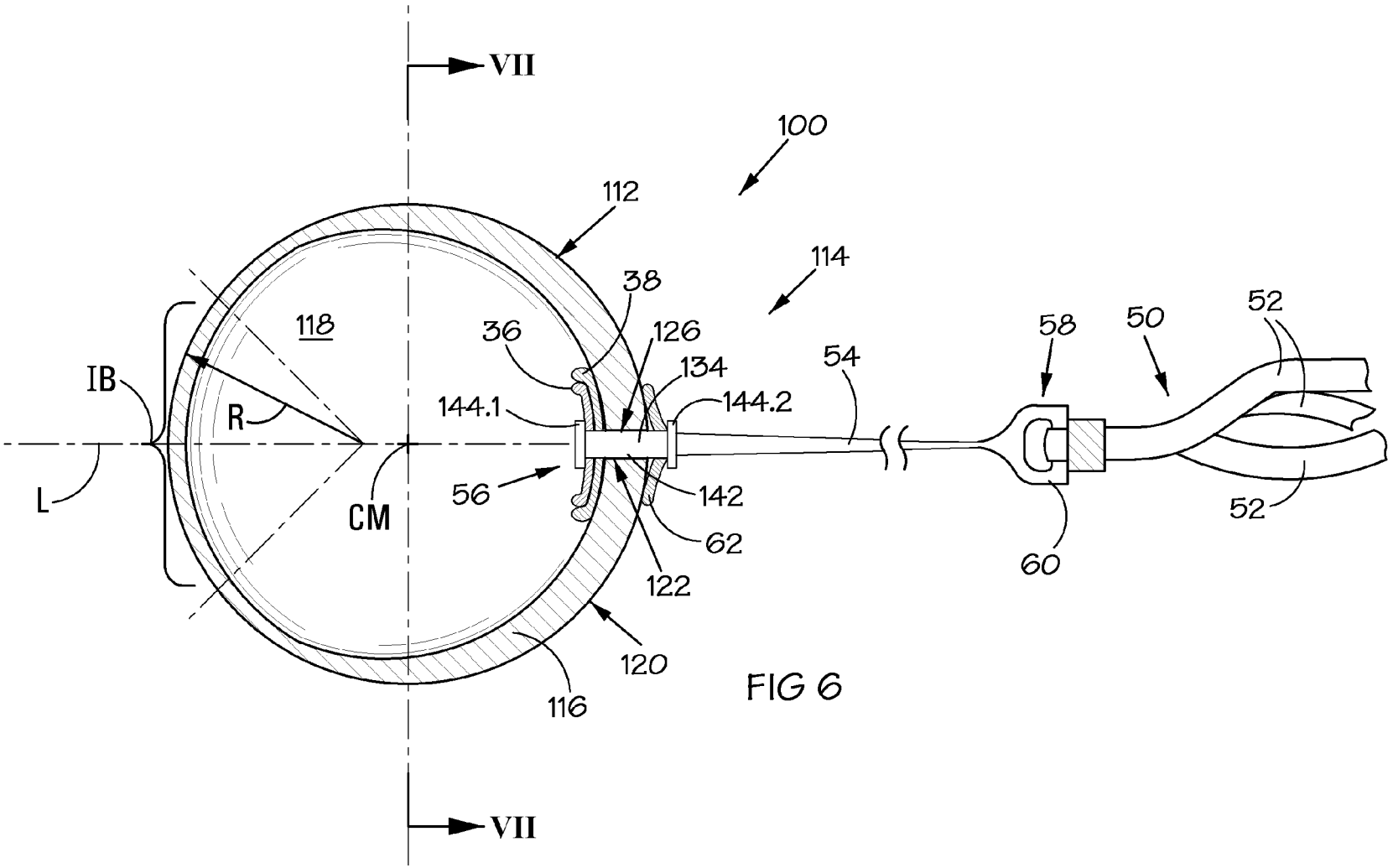
FIG. 6 shows a sectional top view of another embodiment of a ball in accordance with the invention, which is configured for use as a streamer ball.
Figure 7:
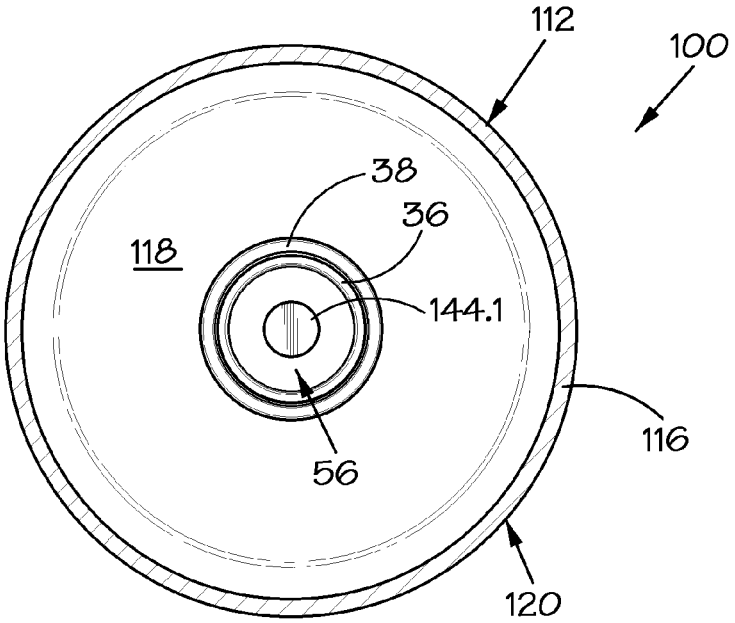
FIG. 7 shows a sectional front view of the ball of FIG. 6, sectioned along section line VII-VII of FIG. 6.
Figure 8:
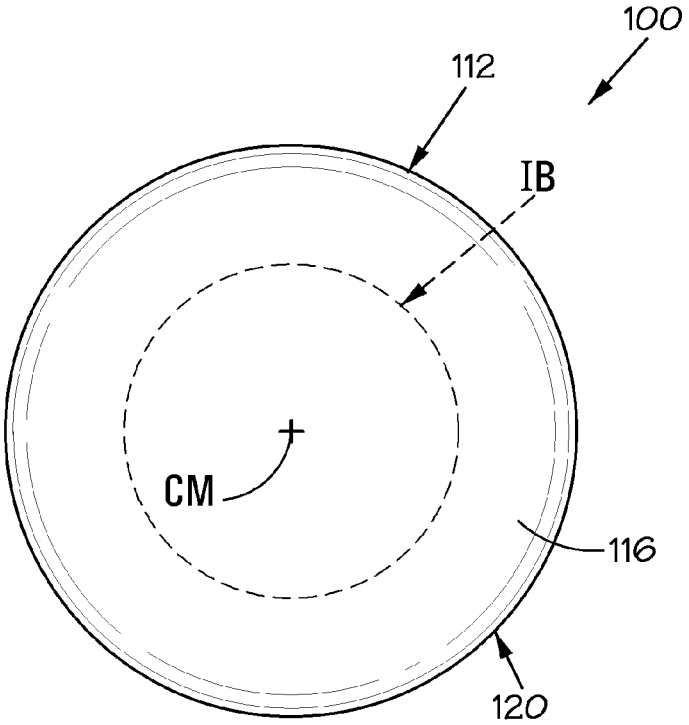
FIG. 8 shows a front view of the ball of FIG. 6.

FIG. 5 illustrates the deformation of the impact zone of the impact body when the impact body is struck by a bat 39.

With reference to FIGS. 6 to 9 of the drawings, a ball in accordance with the invention which is configured for use as a streamer ball, is designated generally by the reference numeral 100. The ball 100 is similar to the ball 10. As such, features of the ball 100 which are the same as and/or similar to features of the ball 10, are designated in FIGS. 6 to 9 by the same and/or similar reference numerals.

The ball 100 is configured for use with bats having untensioned rigid ball striking surfaces and comprises, broadly, a hollow spherical impact body 112 and flight control means in the form of a flight control assembly designated generally by the reference numeral 114.

The impact body comprises a wall 116 of a resiliently compressible high grade rubber or rubber-like material surrounding an internal space 118. Due to the provision of the hole 122, the internal space 118 has a pressure approximately equal to atmospheric pressure when the ball is in a relaxed state and not deformed inwardly by a blow from a bat. The wall 116 defines a substantially smooth external surface 120. The impact body has a mass of between 10 g and 50 g and a diameter of between 25 mm and 95 mm and defines a centre of mass CM. The impact body defines a hole 122 of between 3 mm and 20 mm in diameter, providing an attachment point for the flight control assembly 114.

The impact body defines a single impact zone IB which is defined by the wall of the impact body and which has a wall thickness of between 1 mm and 3 mm. In the illustrated example, the wall thickness of the wall of the impact zone, is uniform. It will be appreciated, however, that the wall thickness of the impact body within the impact zone IB may preferably vary between a minimum of 1 mm and a maximum of 3 mm. The part of the wall of the impact body defining the impact zone, has a mass of between 0.15 g and 0.4 g per square centimeter of the wall, corresponding to an average wall thickness of between 1 mm and 3 mm. The thickness of the wall of the impact body in regions of the impact body outside of the impact zone is relatively thicker. The impact zone is thus defined by a reduction in the wall thickness of the impact body in the impact zone. The impact zone IB is convexly curved and has a predetermined radius of curvature "R" defined along an outer profile of the wall.

The flight control assembly 114 includes a tail 50 comprising one or more elongate thin flexible streamers 52, an elongate resiliently flexible spacer stem 54 and an anchor fitting 126. The spacer stem has a proximal end 56 which is attached to the impact body and a distal end 58 having an attachment formation 60 providing for attachment of the tail 50 to the spacer stem.

The anchor fitting 126 comprises, broadly, an anchor body 134 which is integrally formed with the spacer stem, a disc-shaped shoulder-defining body 36, a flexible resilient internal cushioning washer 38 and a flexible resilient external retaining washer 62. More specifically, the anchor body 134 comprises an elongate shank portion 142 which operatively extends through the hole 122 defined in the wall of the impact body. The shank portion has a pair of flanges 144.1 and 144.2 at opposite ends thereof. More particularly, the flange 144.1 is disposed at an inner end of the shank portion and abuts an inner side of the shoulder-defining body 36, with the flange 144.2 being disposed at an outer end of the shank portion, externally of the impact body. The external washer 62 is located between an external side of the impact body and the flange 144.2 in a tensioned state, thereby limiting axial displacement of the shank portion within the hole 122.

The shank portion 142 of the anchor body 134 is received in the hole 122 in a fit which is not airtight, thereby resulting in the internal space 18 of the impact body, having an internal pressure equal to ambient pressure when the impact body is in a relaxed state and not deformed inwardly by a blow from a bat.

The elongate spacer stem 54 defines a longitudinal axis L along the length thereof which intersects the centre of mass CM of the impact body and passes through a centre of the impact zone IB. The impact zone IB is thus disposed diametrically opposite the attachment point defined by the hole 122 of the impact body. It will be appreciated that the impact zone IB defines a leading end of the impact body and the attachment point defined by the hole 122 defines a trailing end of the impact body in flight. The configuration of the impact body and in particular, the reduced wall thickness of the impact body within the impact zone is such that the impact zone compresses to a minimum compression depth of 12 mm and the impact body bounces to a height of at least 100 cm when the impact body is subjected to the drop test as described hereinabove.

Figure 9:
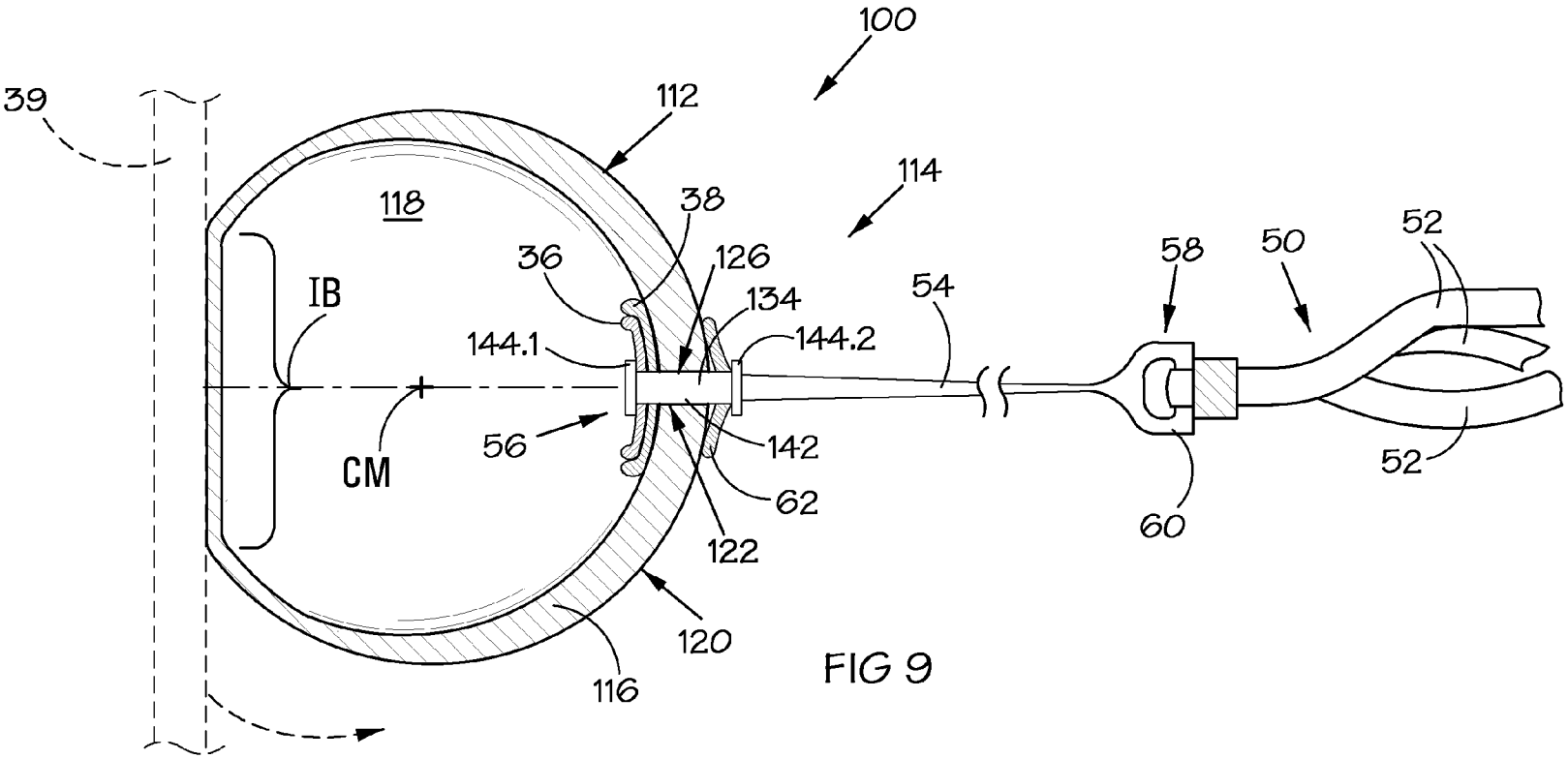
FIG. 9 shows a sectional top view of the ball of FIG. 6, sectioned along section line IX-IX of FIG. 6, illustrating the deformation of the impact body when struck by a bat.

FIG. 9 illustrates the deformation of the impact zone IB of the impact body when the impact body is struck by a bat 39.

Figure 10A:
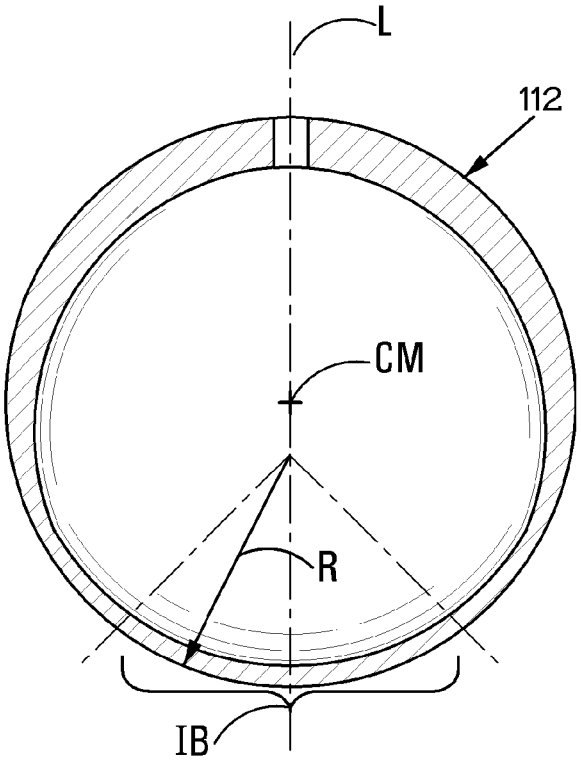
FIGS. 10*a* and 10*b* show sectional side views of an impact body of the ball of FIG. 6 which is subjected to a drop test, before and upon impact with a test impact surface, respectively, illustrating compression of the impact zone of the impact body upon impact with the test impact surface.
Figure 10B:
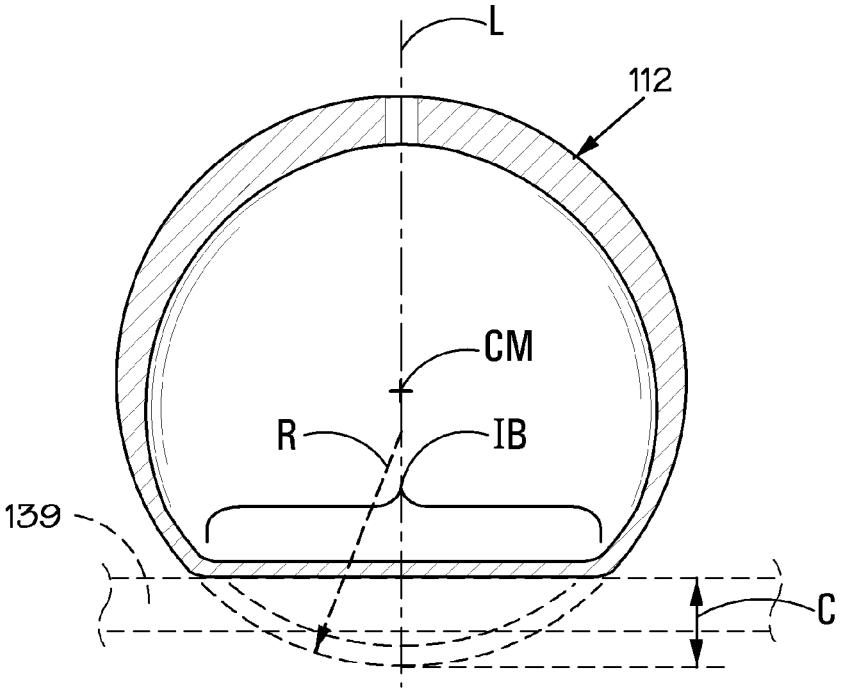

FIG. 10*a* shows a sectional side view of the impact body 112 of the streamer ball 100 in a relaxed, uncompressed state prior to impact with a test impact surface 139, while FIG. 10*b* shows a sectional side view of the impact 112 upon impact with the test impact surface when the impact body is subjected to a drop test. It will be appreciated that impact with the test impact surface simulates impact by a bat.

FIG. 10*b* illustrates the compression of the impact zone IB of the impact body 112 upon impact with the test impact surface. At maximum compression of the impact zone, the impact zone compresses to a minimum compression depth of 12 mm. Thereafter, the impact body bounces to a height of at least 100 cm.

It will be appreciated that in a similar drop test, the impact body 12 of the tethered ball 10, exhibits the same test results wherein the impact zone IA compresses to a minimum compression depth of 12 mm. Thereafter, the impact body bounces to a height of at least 100 cm.

Figure 11:
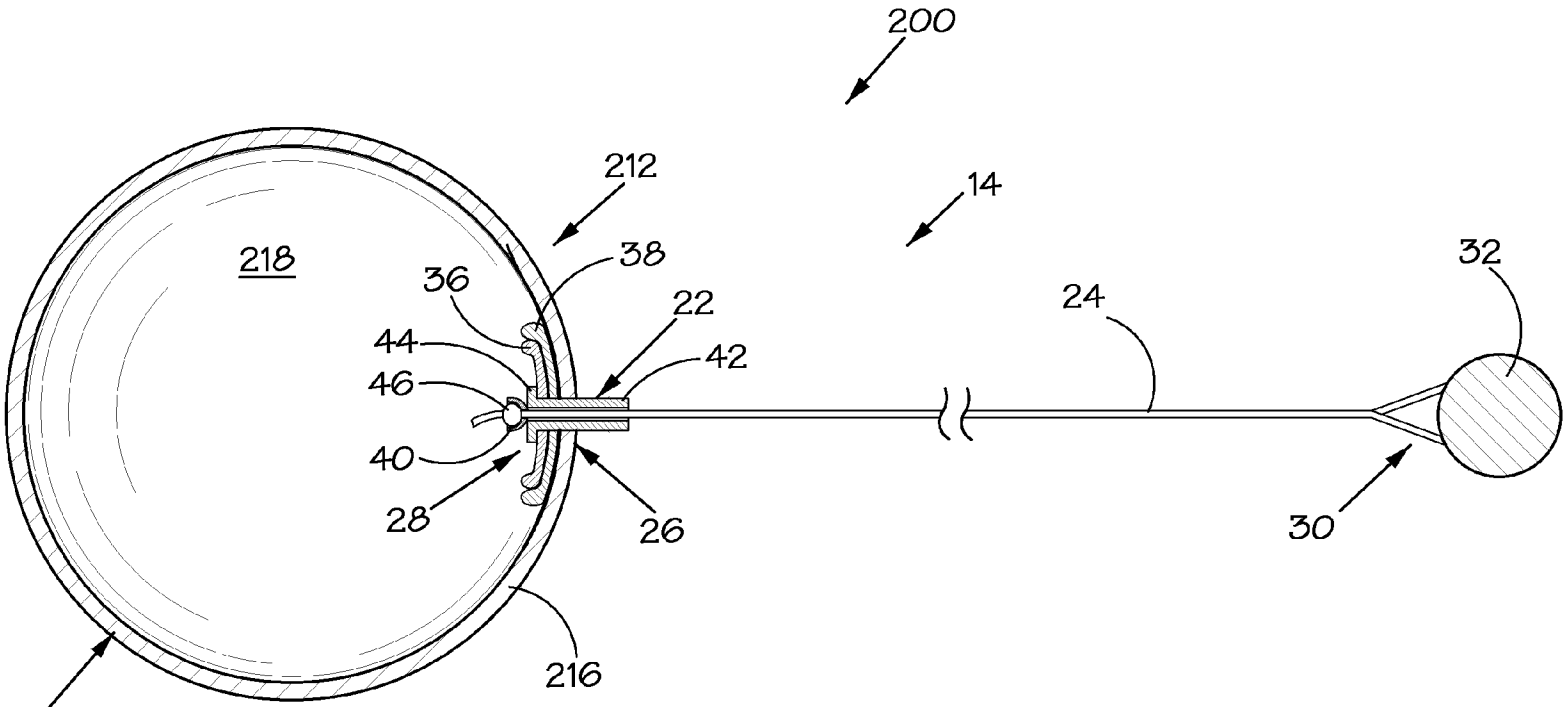
FIG. 11 shows a sectional top view of a further embodiment of a ball in accordance with the invention, configured for use as a tethered ball.

FIG. 11 shows a further embodiment of a ball in accordance with the invention which is designated by the reference numeral 200 and which is configured for use as a tethered ball. The ball 200 is similar to the ball 10, with the only difference being that the wall of the impact body of the ball 200 has a uniform thickness throughout of between 1 mm and 3 mm resulting in the entire wall having the characteristics of an impact zone which compresses to a minimum compression depth of 12 mm and bounces to a height of at least 100 cm when the impact body is subjected to the drop test described hereinabove.

Figure 12:
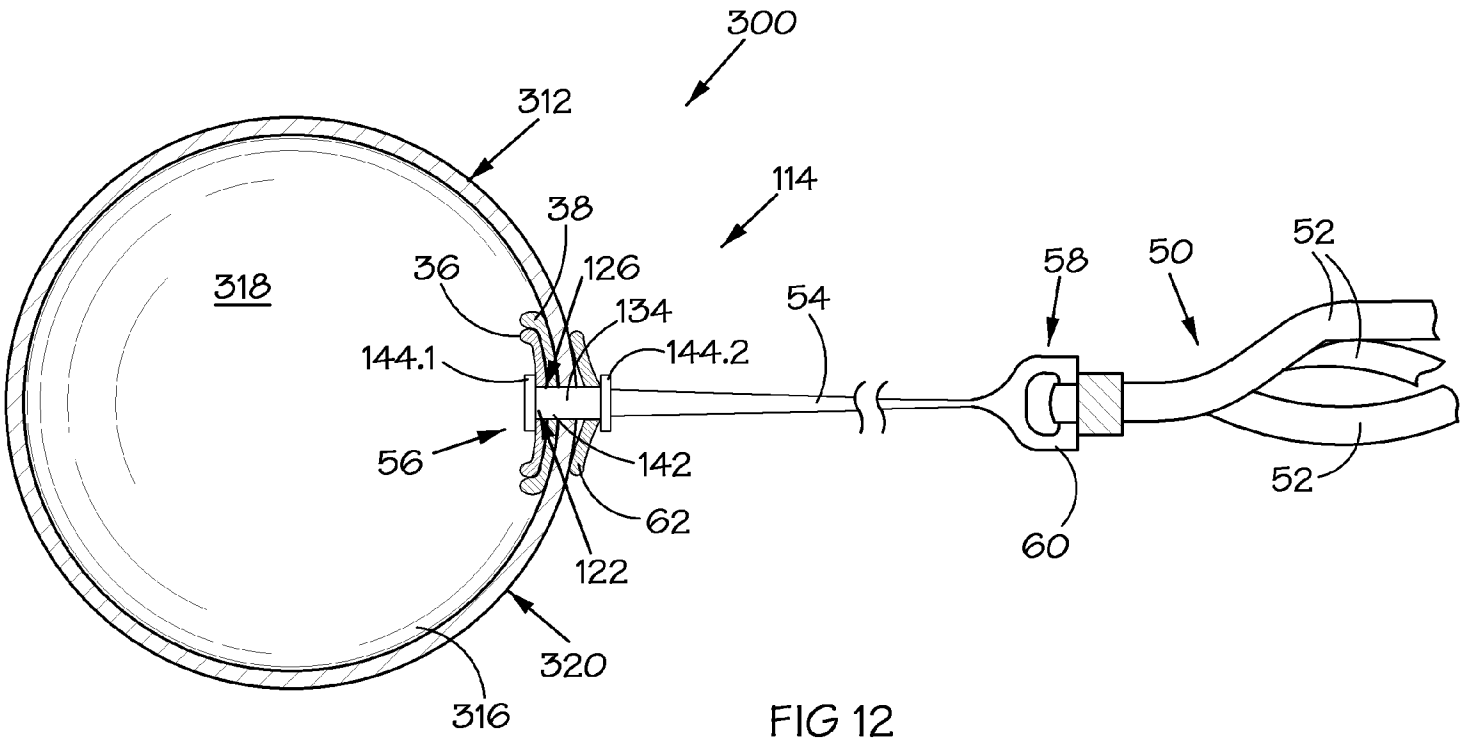
FIG. 12 shows a sectional side view of yet another embodiment of a ball in accordance with the invention, configured for use as a streamer ball.

FIG. 12 shows yet another embodiment of a ball in accordance with the invention which is designated by the reference numeral 300 and which is configured for use as a streamer ball. The ball 300 is similar to the ball 100 with the only difference being that the wall of the impact body has a uniform thickness throughout of between 1 mm and 3 mm resulting in the entire wall constituting an impact zone wherein the impact body compresses to a minimum compression depth of 12 mm and bounces to a height of at least 100 cm when the impact body is subject to the drop test described hereinabove.

Figure 13:
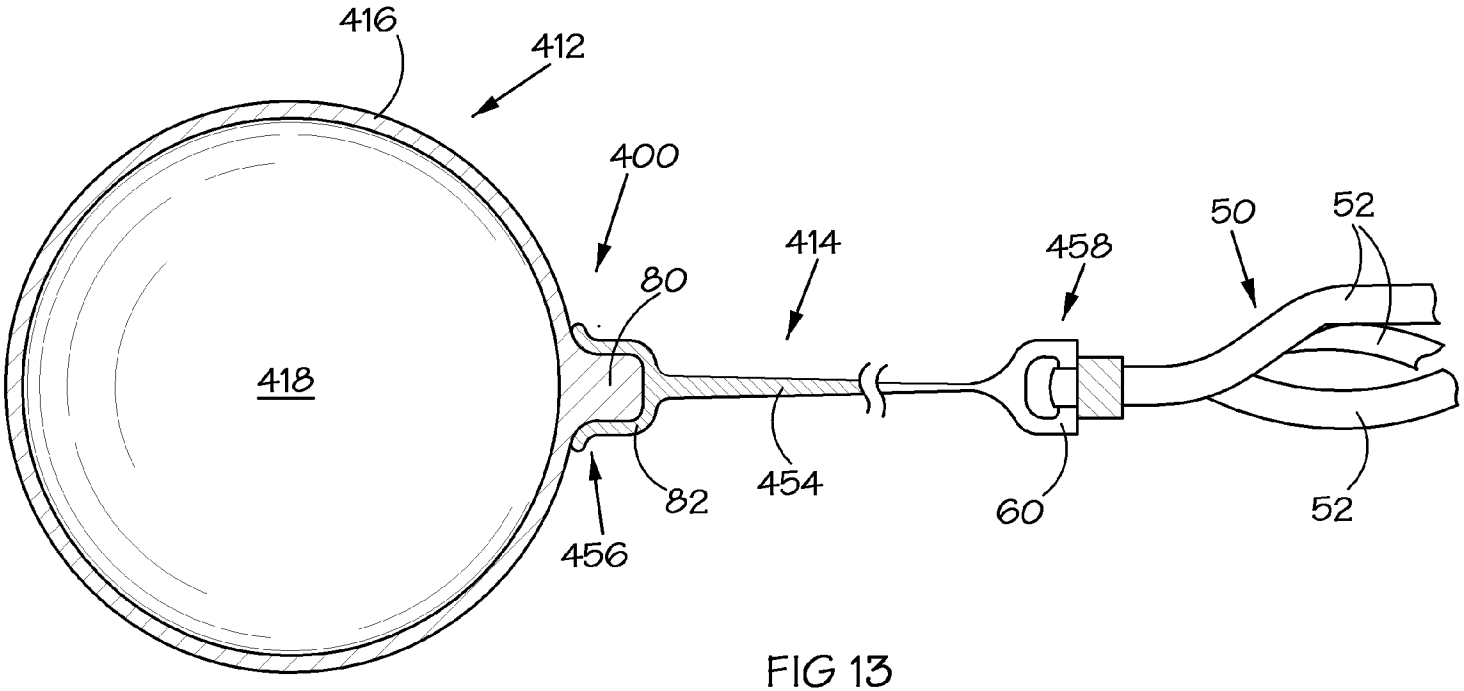
FIG. 13 shows a sectional side view of a further embodiment of a ball in accordance with the invention, which is configured for use as a streamer ball.

FIG. 13 shows a further embodiment of a ball in accordance with the invention, which is designated by the reference 400. The ball 400 is similar to the ball 300, with the main difference being that ball includes flight control means in the form of a flight control assembly 414 which is attached to an external side of the wall 416 of the impact body 412. Features of the ball 400 which are the same as and/or similar to features of the ball 300, are designated in FIG. 13 by the same and/or similar reference numerals.

The impact body defines a spigot formation 80 which projects from the wall 412 thereof for attachment of the flight control assembly to the impact body. The flight control assembly 414 includes a tail 50 comprising streamers 52 and an elongate resiliently flexible spacer stem 454 having a proximal end 456 and a distal end 458. The distal end has an attachment formation 60 providing for attachment of the tail to the spacer stem. The proximal end of the spacer stem defines a socket formation 82 defining a socket within which the spigot formation 80 of the impact body is securely received for securely attaching the spacer stem to the impact body.

The Applicant believes that the flight-controlled tethered and streamer balls, in accordance with the invention, provide the characteristics required for use with lightweight bats having untensioned, rigid ball-striking surfaces. More specifically, the impact body of the flight-controlled balls in accordance with the invention, are relatively light in weight as is required for use with lightweight bats and exhibit a sufficiently high degree of compression upon impact by a bat so as to achieve a solid contact between the impact body and the bat with minimal unpleasant handle vibration. The applicant believes that this characteristic is due to the fact that the impact body spreads out over the ball-striking surface of the bat thereby making contact with the bat over a relatively large surface area which has the result of reducing the contact pressure between the bat and the impact body upon impact by the bat.

Reducing the weight of the impact body to between 10 g and 50 g enables the use of a bat weighing at most only 250 g (based on an impact body to bat weight ratio of 1:5 using the maximum impact body weight of 50 g). This allows significant drop in the bat weight from around 300 g for a conventional unstrung, rigid-faced bat as described hereinafter in the "Background To Invention" section of this specification.

It should also be appreciated that the average wall thickness of the rubber core of a regulation tennis ball is approximately 3.5 mm. A maximum wall thickness of the impact zone of the impact body of the balls in accordance with the present invention, of 3 mm, is envisaged which results in the significant advantageous performance characteristics described herein.

Furthermore, the provision of a relatively thin wall at least in the impact zone of the impact body, renders the impact zone of the impact body relatively more flexible so that the impact body compresses more on impact (as measured by the size of the impact contact mark made by the impact body during impact as is evident from the drop test described herein) despite the lighter weight of the impact body. This permits the transfer of more kinetic energy from the moving bat to the impact body during contact with the impact body as the impact body is in contact with the bat for a longer period of time. The relatively thinner wall of the impact body at least in the region of the impact zone, causes less energy to be expended in the deformation process when the impact zone of the impact body flattens upon impact by a bat. As a result, more energy is available to be transferred to the impact body itself enabling enhanced spring off the bat. Tests conducted by the Applicant on the bounce characteristics of such thin-walled impact bodies support this contention as is further evidenced by the drop test characteristics for the impact body, as described hereinabove.

Furthermore, it follows that the performance of such balls may be enhanced by providing an impact body having a variable wall thickness wherein the wall thickness of the impact body outside the impact zone may be selectively made relatively thicker so as to avoid excessive loss of weight of the impact body as a whole. The extra weight provided by the thicker wall section contributes to the overall weight of the impact body thereby increasing the compression depth of the impact body at impact.

Figure 14A:
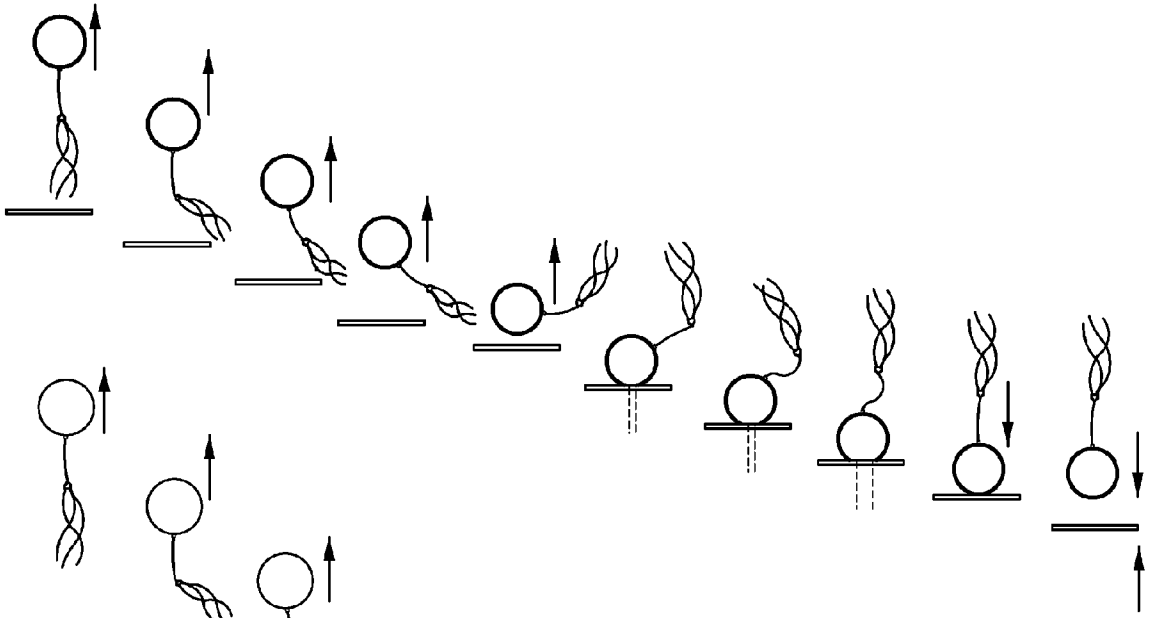
FIG. 14*a* shows the flight orientation and deformation of a streamer ball having a relatively thicker-walled impact body, before, during and after impact by a bat.
Figure 14B:
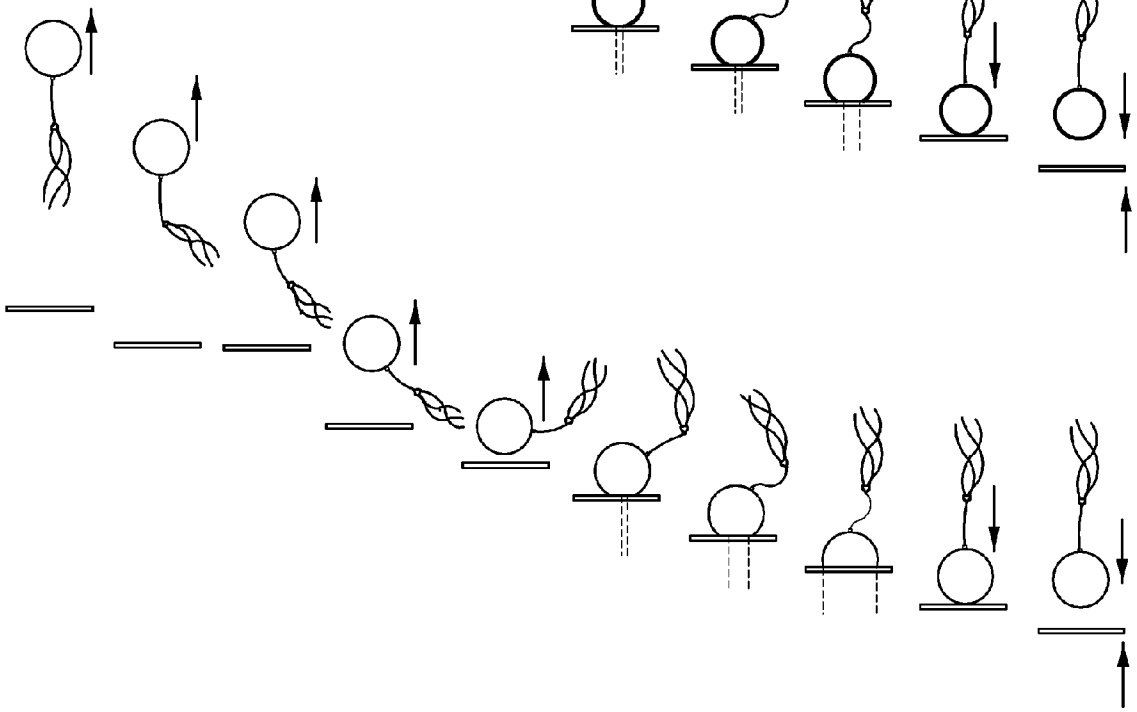
FIG. 14*b* shows the flight orientation and deformation of a streamer ball having a relatively thinner-walled impact body, before, during and after impact by a bat.

In FIGS. 14*a* and 14*b* of the drawings, a comparison is provided illustrating the difference in flight characteristics and deformation of a streamer ball having a relatively thicker-walled impact body (as shown in FIG. 14*a*) and a streamer ball having a relatively thinner-walled impact body (as shown in FIG. 14*b*). As the comparison requires the thicker and thinner-walled impact bodies to be the same mass it follows that the thicker-walled impact body will have a relatively smaller diameter than the thinner-walled impact body. From the comparison, it can be seen that the thinner-walled impact body spreads out more over the bat surface at impact compared to the thicker-walled impact body, resulting in a bigger contact footprint. This results in a more desirable solid impact feel with less vibration of the bat. It will be appreciated that the bigger contact footprint of a thinner-walled impact body means that the impact body has compressed more and is thus in contact with the bat for longer, resulting in more energy being imparted to the impact body during this time so as to result in a increased departure speed of the impact body off the bat.

More specifically, a thinner-walled impact body absorbs less energy while deforming compared to a thicker-walled impact body and as a result, springs back to its original shape more quickly while pressing against the bat and therefore departs from the bat at greater speed.

FIGS. 14*a* and 14*b* therefore illustrate the beneficial characteristics imparted to the balls 10, 100, 200, 300 and 400 in accordance with the invention, by the relatively thinner-walled impact zones of each of the impact bodies of the balls which thus provide for departure of the impact body at a higher speed off a bat at impact, the dispersal of the impact shock over a wider area of the impact body and the bat and a longer dwell time on the bat, resulting in a sweeter impact feel with less shock and vibration.

The invention claimed is:

1. A ball for use in bat and ball games wherein the ball is struck with a bat having an untensioned, rigid ball-striking surface, the ball comprising:

a hollow, impact body having a mass of between 10 g and 50 g, the impact body comprising a wall of a resiliently compressible material surrounding an internal space, the wall defining at least one impact zone configured for impact by the bat, the part of the wall of the impact body defining the impact zone having an average wall thickness of between 1 mm and 3 mm and a mass of between 0.15 g and 0.4 g per square centimeter of the wall; and flight control means which is attached to the impact body at an attachment point on the wall of the impact body, the flight control means being operable to control the orientation of the impact body in flight, the configuration of the impact body being such that the impact zone of the impact body compresses to a minimum compression depth of 12 mm and the impact body bounces to a height of at least 100 cm when subjected to a drop test wherein the impact body is dropped from a height of 254 cm onto a rigid test impact surface such that the impact zone of the impact body impacts the test impact surface, the impact body having a variable wall thickness wherein the thickness of the wall of the impact body within the impact zone is relatively thinner than the thickness of the wall of the impact body externally of the impact zone.

2. The ball as claimed in claim 1, wherein the impact zone has a wall thickness of between 1 mm and 3 mm.

3. The ball as claimed in claim 1, wherein the ball is configured for use as a streamer ball, the flight control means including a tail comprising at least one elongate thin, flexible streamer configured to trail behind the impact body in flight; and an elongate, resiliently flexible spacer stem having a proximal end which is attached to the wall of the impact body at said attachment point and a distal end which is attached to the tail.

4. The ball as claimed in claim 3, wherein the impact zone is disposed diametrically opposite the attachment point of the spacer stem to the impact body, the central longitudinal axis of the impact body passing through the attachment point and a centre of the impact zone.

5. The ball as claimed in claim 4, wherein the flight control means further includes an anchor fitting having an anchor body for anchoring the spacer stem to the wall of the impact body, the impact body defining a hole within which the anchor body is securely located.

6. The ball as claimed in claim 4, wherein the impact body defines an attachment formation for attaching the spacer stem to the wall of the impact body, the flight control means further including an anchor fitting including an anchor body which is integrally formed with the spacer stem and which is configured for attachment to the attachment formation of the impact body.

7. The ball as claimed in claim 1, wherein the ball is configured for use as a tethered ball, the flight control means including a tether cord having a proximal end which is attached to the wall of the impact body at said attachment point and a distal end which is rotatably attached to an anchor point at a location remote from the impact body and around which the impact body is struck, in use.

8. The ball as claimed in claim 7, and wherein the impact zone is in the form of an impact band extending around the impact body, a tether cord axis extending along the length of the tether cord and passing through the centre of mass of the impact body, passes through a centre of the impact band when the impact band is viewed in plan view.

9. The ball as claimed in claim 7, wherein the flight control means includes an anchor fitting having an anchor body for anchoring the tether cord to the wall of the impact body, the impact body defining a hole within which the anchor body is securely located.

* * * * *